US010234778B2

(12) United States Patent
Uchino et al.

(10) Patent No.: US 10,234,778 B2
(45) Date of Patent: Mar. 19, 2019

(54) ELECTROSTATIC CHARGE IMAGE DEVELOPING TONER

(71) Applicant: Konica Minolta, Inc., Tokyo (JP)

(72) Inventors: Satoshi Uchino, Hino (JP); Shinya Obara, Fuchu (JP); Junya Ueda, Hino (JP); Takuya Takahashi, Higashimurayama (JP)

(73) Assignee: KONICA MINOLTA, INC., Tokyo (JP)

( * ) Notice: Subject to any disclaimer, the term of this patent is extended or adjusted under 35 U.S.C. 154(b) by 48 days.

(21) Appl. No.: 15/699,394

(22) Filed: Sep. 8, 2017

(65) Prior Publication Data

US 2018/0074421 A1 Mar. 15, 2018

(30) Foreign Application Priority Data

Sep. 15, 2016 (JP) ..... 2016-180156

(51) Int. Cl.

| | |
|---|---|
| ***G03G 9/087*** | (2006.01) |
| ***G03G 9/08*** | (2006.01) |
| ***G03G 9/093*** | (2006.01) |
| ***G03G 9/097*** | (2006.01) |

(52) U.S. Cl.

CPC ..... *G03G 9/08755* (2013.01); *G03G 9/0821* (2013.01); *G03G 9/0825* (2013.01); *G03G 9/0827* (2013.01); *G03G 9/08711* (2013.01); *G03G 9/09328* (2013.01); *G03G 9/09371* (2013.01); *G03G 9/09378* (2013.01); *G03G 9/09385* (2013.01); *G03G 9/09716* (2013.01); *G03G 9/09725* (2013.01)

(58) Field of Classification Search

CPC .. G03G 9/0821; G03G 9/0825; G03G 9/0827; G03G 9/08755; G03G 9/09725

See application file for complete search history.

(56) References Cited

U.S. PATENT DOCUMENTS

2015/0309431 A1* 10/2015 Katsumata ..... G03G 9/08755 430/105

FOREIGN PATENT DOCUMENTS

| | | |
|---|---|---|
| JP | 4729950 B2 | 4/2011 |
| JP | 4742936 B2 | 5/2011 |

* cited by examiner

*Primary Examiner* — Peter L Vajda

(74) *Attorney, Agent, or Firm* — Lucas & Mercanti, LLP

(57) ABSTRACT

An electrostatic charge image developing toner includes toner particles including a particulate toner matrix and an external additive adhering to a surface of the particulate toner matrix. The particulate toner matrix includes a crystalline polyester resin. The external additive includes silica particles. The silica particles are secondary particles including primary particles having a diameter in the range of 30 to 90 nm. The secondary particles have an average circularity in the range of 0.25 to 0.50. The secondary particles have an average aspect ratio of 3.0 or more.

14 Claims, 1 Drawing Sheet

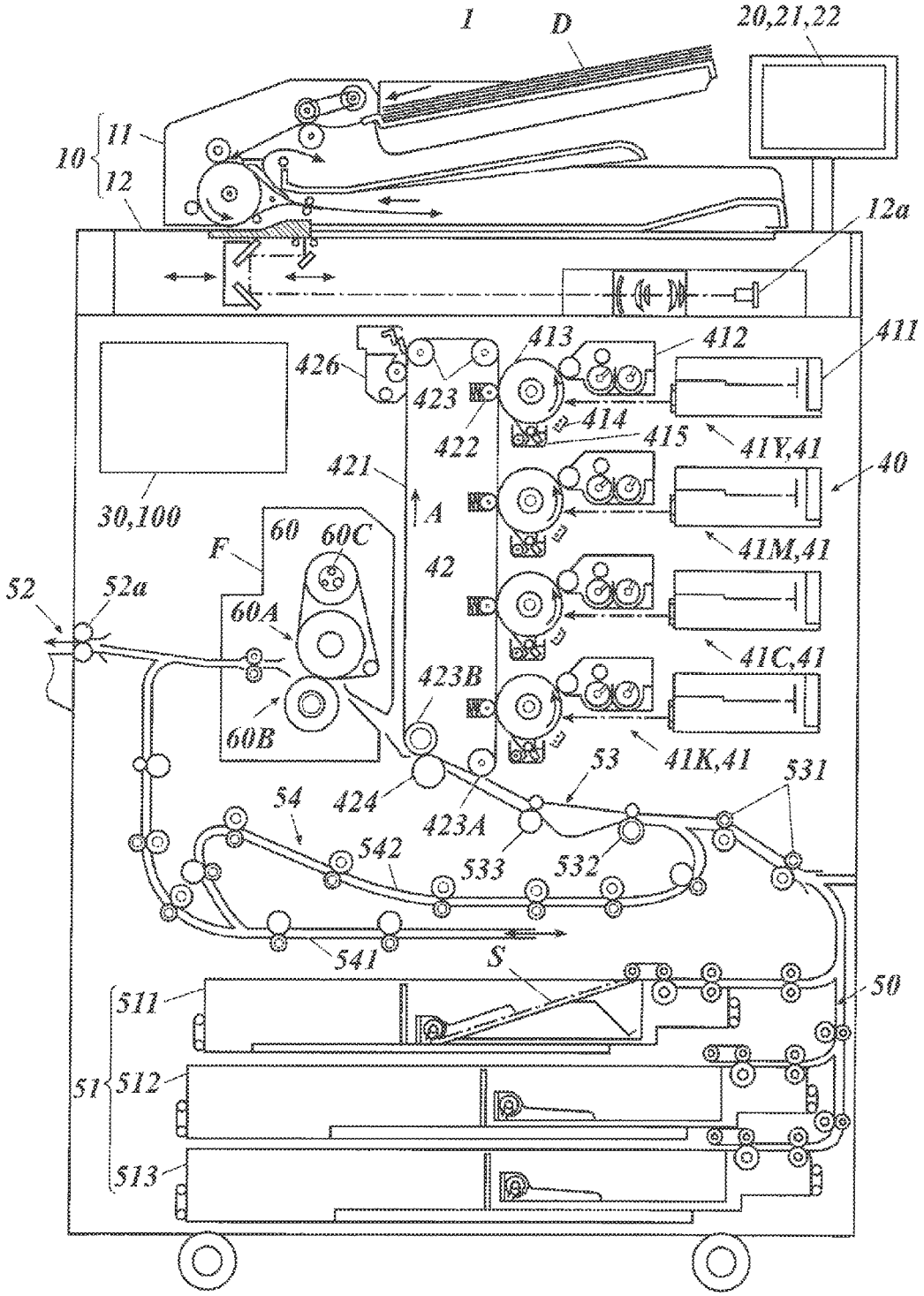
1
D
20,21,22
10
11
12
12a
426
423
413
412
411
422
414
415
41Y,41
421
A
40
30,100
60
60C
F
42
41M,41
52
52a
60A
41C,41
423B
60B
41K,41
53
531
54
424
423A
542
533
532
541
S
511
50
51
512
513

ELECTROSTATIC CHARGE IMAGE DEVELOPING TONER

CROSS-REFERENCE TO RELATED APPLICATIONS

Japanese Patent Application No. 2016-180156 filed on Sep. 15, 2016, including description, claims, drawings, and abstract of the entire disclosure is incorporated herein by reference in its entirety.

BACKGROUND

Technological Field

The present invention relates to an electrostatic charge image developing toner. More specifically, the present invention relates to an electrostatic charge image developing toner having compatibility between low-temperature fixing characteristics and high image storage property.

Description of the Related Art

Electrostatic charge image developing toners (hereinafter, simply referred to as "toner") used in electrophotographic image formation should have reduced thermal energy during fixing of images to achieve a higher print rate and energy-saving image forming apparatuses. To satisfy this requirement, a toner having higher low-temperature fixing characteristics has been desired. It is known in the design of such a toner that a binder resin having sharp-melt characteristics, such as a crystalline polyester resin, is introduced into a particulate toner matrix to reduce the glass transition temperature or melt viscosity of the binder resin.

For example, it is known to use a binder resin mixture of an amorphous resin with a crystalline polyester resin having high compatibility with the amorphous resin. The combined use of such a crystalline polyester resin can enhance the low-temperature fixing characteristics of the toner because the crystalline polyester resin acts as a plasticizer during thermal fixing.

Other toners having low-temperature fixing characteristics are also known that are prepared as follows: Toner is prepared such that the particulate toner matrix contains crystal domains of a crystalline polyester resin, and the crystal domains are melted under thermal energy having a temperature higher than the melting point of the crystalline polyester resin during thermal fixing to be compatible with an amorphous resin (for example, see Japanese Patent Nos. 4729950 and 4742936).

Unfortunately, these toners are plasticized due to compatibilization of the amorphous resin with the crystalline polyester resin, resulting in reduced image storage property of fixed images after thermal fixing.

SUMMARY

The present invention has been made in consideration of the problems and circumstances described above. An object of the present invention is to provide an electrostatic charge image developing toner having compatibility between low-temperature fixing characteristics and high image storage property.

The present inventors, who have conducted extensive research to solve the problems, have found that low image storage property after low-temperature fixing can be solved by the addition of a crystalline polyester resin to provide low-temperature fixing and the control of the diameter of primary silica particles contained as an external additive and the average circularity and average aspect ratio of the secondary silica particles in specific ranges, achieving the compatibility between the low-temperature fixing characteristics and high image storage property. The present invention has thereby been made.

To achieve at least one of the abovementioned objects, according to an aspect of the present invention, an electrostatic charge image developing toner including toner particles including a particulate toner matrix, and an external additive adhering to a surface of the particulate toner matrix, wherein the particulate toner matrix includes a crystalline polyester resin, the external additive includes silica particles, the silica particles are secondary particles including primary particles having a diameter in the range of 30 to 90 nm, the secondary particles have an average circularity in the range of 0.25 to 0.50, and the secondary particles have an average aspect ratio of 3.0 or more.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

FIG. 1 is a schematic view illustrating an image forming apparatus which can use the electrostatic charge image developing toner according to the present invention.

DETAILED DESCRIPTION OF EMBODIMENTS

Hereinafter, one or more embodiments of the present invention will be described with reference to the drawings. However, the scope of the invention is not limited to the disclosed embodiments.

The present inventors have found that the image storage property is affected by the formulation of the external additive. In other words, it is found that a large amount of external additive present in the toner on a fixed image results in high image storage property. It is believed that a high content of the external additive present in the toner on the fixed image can be achieved through an increase in the amount of the external additive to be added to the particulate toner matrix and/or use of an external additive having a large primary particle diameter of 30 nm or more (hereinafter, also referred to as "large-diameter external additive").

The present inventors, however, who have conducted extensive research about silica added in a relatively large amount, have found that mere use of an external additive having a large particle diameter leads to low image storage property of output images after a large number of print outputs performed at a low coverage rate (hereinafter, also referred to as "after low coverage printing"). It is believed that such low image storage property occurs because the large-diameter external additive migrates into the depressions of the particulate toner matrix and thus does not stay on the surface of the fixed image.

The present inventors have found that the migration of the external additive into depressions can be reduced and high image storage property is kept after low coverage printing by an external additive of secondary silica particles that at least consist of primary particles having a diameter in the range of 30 to 90 nm, where the secondary particles have an average circularity in the range of 0.25 to 0.50 and an average aspect ratio of 3.0 or more. The present inventors thus have completed the present invention.

The present inventors infer the reason of the advantageous effects achieved by such a configuration according to the present invention as follows.

It is believed that silica particles having a primary particle diameter of less than 30 nm are buried in the toners on the image, and can exhibit no spacer effect. As a result, high image storage property cannot be kept. Silica particles having a primary particle diameter of more than 90 nm increase the secondary particle diameter thereof, causing detachment of the silica particles during the developing or transfer process, and thus an insufficient amount of silica stays in the toner on the image, resulting in low image storage property.

In secondary silica particles having a circularity of less than 0.25, the primary particles thereof tend to have a diameter smaller than the lower limit of the primary particle diameter described above. As a result, such silica particles are buried in the toner on the image, and cannot exhibit the spacer effect. In secondary silica particles having a circularity of more than 0.50, such silica particles migrate into depressions of the particulate toner matrix, and cannot stay on the surface of the fixed image, resulting in low image storage property.

Use of secondary silica particles having an average aspect ratio of 3.0 or more can reduce the migration of the external additive into the depressions of the particulate toner matrix, and keep high image storage property even after low coverage printing.

The electrostatic charge image developing toner according to the present invention includes toner particles including a particulate toner matrix, and an external additive adhering onto the surface of the particulate toner matrix, wherein the particulate toner matrix includes a crystalline polyester resin, the external additive includes silica particles, the silica particles being secondary particles including primary particles having a diameter in the range of 30 to 90 nm, the secondary particles having an average circularity in the range of 0.25 to 0.50 and an average aspect ratio of 3.0 or more. Such a concept is a technical feature common to the claimed inventions. The present invention thereby achieves the compatibility between low-temperature fixing characteristics and high image storage property.

In an embodiment of the present invention, the toner particles preferably have an average circularity in the range of 0.945 to 0.965. Such toner particles can keep higher image storage property after low coverage printing.

In an embodiment of the present invention, the external additive preferably further contains titanium oxide particles having an average aspect ratio in the range of 3.0 or more. Such titanium oxide particles can keep higher image storage property after low coverage printing.

In an embodiment of the present invention, the titanium oxide particles preferably have an average major axis diameter in the range of 30 to 70 nm. Such titanium oxide particles can keep higher image storage property after low coverage printing.

In an embodiment of the present invention, the silica particles preferably have surfaces modified with silicone oil. Such silica particles can keep higher image storage property.

In an embodiment of the present invention, the silica particles preferably have surface modified with a trimethylsilyl group. Such silica particles can suitably provide the advantageous effects of the present invention.

In an embodiment of the present invention, the content of the silica particles is preferably in the range of 2.0 to 5.0 mass % relative to 100 mass % of the particulate toner matrix. Such a content of silica particles can provide high image storage property and high image quality.

In an embodiment of the present invention, the content of the titanium oxide particles is preferably in the range of 0.10 to 0.80 mass % relative to 100 mass % of the particulate toner matrix. Such a content of titanium oxide particles can suitably provide the advantageous effects of the present invention.

In an embodiment of the present invention, the titanium oxide particles preferably have a rutile crystal structure. Such titanium oxide particles can keep high image storage property.

In an embodiment of the present invention, the titanium oxide particles preferably have surfaces modified with a coupling agent having a linear alkyl group having six to ten carbon atoms. Such titanium oxide particles can suitably provide the advantageous effects of the present invention.

In an embodiment of the present invention, the titanium oxide particles preferably have surfaces modified with an octylsilyl group. Such titanium oxide particles can suitably provide the advantageous effects of the present invention.

In an embodiment of the present invention, the crystalline polyester resin preferably includes a hybrid crystalline polyester resin prepared through chemical bond of at least a crystalline polyester polymer segment and a second polymer segment. Such a hybrid crystalline polyester resin can provide high low-temperature off-setting resistance.

In an embodiment of the present invention, the particulate toner matrix preferably has a core-shell structure including at least a core particle and a shell coating the surface of the core particle, wherein the shell includes an amorphous polyester resin. Such a core-shell structure can provide high low-temperature off-setting resistance and high heat resistance of the toner.

In an embodiment of the present invention, the amorphous polyester resin includes a hybrid amorphous polyester resin prepared through chemical bond of at least an amorphous polyester polymer segment and a second polymer segment. Such a hybrid amorphous polyester resin can provide higher low-temperature off-setting and higher image storage property.

The present invention and its constituent and embodiments for achieving the present invention will now be described in detail. Throughout the specification, "to" between two numerical values indicates that the lower limit includes the numeric value before "to" and the upper limit includes the numeric value after "to".

<<Outline of Electrostatic Charge Image Developing Toner>>

The electrostatic charge image developing toner according to the present invention (hereinafter, also simply referred to as "toner") includes toner particles including a particulate toner matrix, and an external additive adhering to the surface of the particulate toner matrix, wherein the particulate toner matrix includes a crystalline polyester resin, and the external additive includes silica particles, the silica particles being secondary particles including primary particles having at least a primary particle diameter in the range of 30 to 90 nm, the secondary particles having an average circularity in the range of 0.25 to 0.50 and an average aspect ratio of 3.0 or more.

In the present invention, the term "toner" refers to aggregation of "toner particles".

[Toner Particles]

The toner particles according to the present invention include a particulate toner matrix, and an external additive adhering to the surface of the particulate toner matrix.

[External Additive]

In the toner according to the present invention, silica particles are contained as an external additive. The silica particles according to the present invention are secondary particles including particles having at least a primary particle diameter in the range of 30 to 90 nm. In other words, the silica particles of this application are in the form of secondary silica particles including primary silica particles. The silica particles are particles including silica. The silica particles may contain other elements or compounds in the range not inhibiting the expression of the advantageous effects of the present invention.

Throughout the specification, the primary silica particles are also simply referred to as "primary particles", and the secondary silica particles are also simply referred to as "secondary particles".

Although the details will be described later, the secondary particles have an average circularity in the range of 0.25 to 0.50 in the present invention. The secondary particles have an average aspect ratio of 3.0 or more in the present invention.

The toner particles may include an external additive other than the silica particles. In particular, the toner particles preferably include titanium oxide particles. Among these, titanium oxide particles having an average aspect ratio of 3.0 or more are preferred because higher image storage property after low coverage printing can be kept.

The titanium oxide particles more preferably have an average major axis diameter in the range of 30 to 70 nm. Such titanium oxide particles can provide higher image storage property after low coverage printing.

<Silica Particles>

The silica particles include silica or $SiO_2$ as a main component, and may be crystalline or amorphous. Examples of the silica particles include those prepared by precipitation using sodium silicate as a raw material, wet silica prepared by a sol-gel process using silicon alkoxide as a raw material, and silica prepared by a gas phase process and consisting of linear or amorphous primary aggregates having strong bonding force and secondary aggregates having significantly weaker bonding force.

The content of silica (content of the silica particles) contained in the toner particles is preferably in the range of 2.0 to 5.0 mass % relative to 100 mass % of the particulate toner matrix. A content of 2.0 mass % or more does not significantly reduce the silica content on the image, providing high image storage property. A content of 5.0 mass % or less can prevent a significantly high charging amount, providing high image quality.

The silica content refers to the total amount of the silica particles according to the present invention and other silica particles (such as silica particles having smaller diameters).

<Preparation of Silica Particles>

The silica particles according to the present invention can be prepared by any process that can prepare silica particles satisfying the relationship specified in the present invention. Examples of preparation of the silica particles according to the present invention include the following gas phase process of preparing silica particles by flame hydrolysis. The following process can produce secondary silica particles satisfying the relationship specified in the present invention.

In a standard gas phase process of preparing silica particles by flame hydrolysis, for example, the gas of a raw material silicon compound, such as silicon tetrachloride, and an inert gas are introduced into a mixing chamber of a burner, and are mixed with hydrogen and air in a predetermined ratio to prepare a mixed gas. This mixed gas is burnt in a reaction chamber at a temperature of 1000 to 3000° C. to generate silica. After being cooled, the generated silica is recovered with a filter. For the detail procedures by flame hydrolysis, see German Patent Nos. 974793, 974974, and 909339.

In a suitable process of preparing the silica particles according to the present invention, amorphous silica is generated through control of the ratio of the amount of the primary combustible gas to be fed relative to the amount of raw material silicon compound to be less than the theoretical ratio "1". For the process, see European Patent No. 07108557.

This process will now be described in detail.

A hydrolyzable raw material silicon compound, a primary oxygen-containing gas, and a primary combustible gas are introduced into a mixing chamber of a burner, and are mixed. The mixture is ignited to be flamed. The mixture is fed into a reaction chamber, and is burnt at a temperature of 1000 to 3000° C. to generate silica particles and a gaseous substance. The silica particles are separated from the gaseous substance to be recovered.

In this process, the maximum amount of the primary combustible gas to be introduced is determined such that the raw material silicon compound is not completely hydrolyzed. In other words, the amount of the primary combustible gas to be introduced is determined to be less than the stoichiometric amount of the combustible gas necessary for complete hydrolysis of the raw material silicon compound.

The ratio $\gamma$ of the amount of the primary combustible gas to be introduced to the stoichiometric amount of the combustible gas is calculated from the following expression. The silica particles according to the present invention can be prepared through control of the primary combustible gas to be introduced such that the ratio $\gamma$ (primary) is less than 1.

Ratio $\gamma$ (primary)=(primary combustible gas to be introduced (mol))/(stoichiometric amount of combustible gas (mol))

The value of the ratio $\gamma$ (primary) is preferably 0.20 to 0.90, more preferably 0.30 to 0.70.

At a ratio $\gamma$ (primary) of less than 1, the silica particles according to the present invention can be suitably prepared. At a ratio $\gamma$ (primary) of 0.20 or more, generation of residual chlorine components in the product can be avoided. Accordingly, the ratio $\gamma$ (primary) in this range is preferred.

The amount of the primary oxygen-containing gas to be introduced is preferably equal to or more than an amount necessary for complete reaction with the primary combustible gas (this amount is referred to as "stoichiometric amount of the primary oxygen-containing gas"). The ratio $\lambda$ (primary) of the amount of the primary oxygen-containing gas to be introduced to the stoichiometric amount of the primary oxygen-containing gas is calculated from the following expression.

Ratio $\lambda$ (primary)=(amount of primary oxygen-containing gas to be introduced (mol))/(stoichiometric amount of primary oxygen-containing gas (mol))

The value $\lambda$ (primary) is desirably 1 or more and 10 or less, preferably in the range of 3 to 10, more preferably in the range of 3 to 7. A small amount of primary oxygen-containing gas, i.e., a ratio $\lambda$ (primary) of 1 or more causes complete combustion, preventing the primary combustible gas and its partially decomposed products from being left in the reaction system. A primary oxygen-containing gas having a ratio λ (primary) of 10 or less is preferred because such a primary oxygen-containing gas can keep a stable flame at a moderate combustion rate.

A secondary or higher-order combustible gas may be fed to one or more sites inside the reaction chamber during preparation of the silica particles according to the present invention. Unlike the primary combustible gas introduced into the mixing chamber of the burner, the higher-order combustible gas is directly fed into the reaction chamber. The inlets for the higher-order combustible gas are preferably disposed in sites affecting the structure of the silica particles in the reaction chamber.

The total amount of the combustible gas to be introduced (i.e., the sum of the primary combustible gas and the higher-order combustible gas) is preferably equal to or more than the stoichiometric amount necessary for complete hydrolysis of the raw material silicon compound. In other words, the ratio γ (total) of the total amount of the combustible gas to be introduced to the stoichiometric amount of the combustible gas is preferably 1 or more, where the ratio γ (total) is calculated from the following expression:

Ratio γ (total)=(total amount of the combustible gas to be introduced (mol))/(stoichiometric amount of combustible gas (mol))

The ratio γ (total) is preferably 1.05 to 4.0, more preferably 1.1 to 2.0. A ratio γ (total) of 1 or more can generate a sufficient steam for the completion of the reaction. A ratio γ (total) of 4 or less can prevent a significant reduction in diameters of the primary silica particles, resulting in suitable preparation of the target silica particles having a large particle diameter in the present invention.

A secondary or higher-order oxygen-containing gas may be fed into one or more places inside the reaction chamber during preparation of the silica particles according to the present invention. Unlike the primary oxygen-containing gas introduced into the mixing chamber of the burner, the higher-order oxygen-containing gas is directly fed into the reaction chamber. The inlets for the higher oxygen-containing gas are preferably disposed in the sites affecting the composition and the structure of the silica particles in the reaction chamber.

The total amount of the oxygen-containing gas to be introduced (i.e., the sum of the primary oxygen-containing gas and the higher oxygen-containing gas) is preferably equal to or more than the amount necessary for complete reaction with the total combustible gas (this amount is referred to as "stoichiometric amount of the oxygen-containing gas"). The ratio λ (total) of the total amount of the oxygen-containing gas to be introduced to the stoichiometric amount of the oxygen-containing gas is calculated from the following expression:

Ratio λ (total)=(total amount of oxygen-containing gas to be introduced (mol))/(stoichiometric amount of oxygen-containing gas (mol))

The ratio λ (total) is 1 or more, desirably more than 1 and 10 or less, preferably 1.5 to 7.0, more preferably 1.8 to 4.0. An oxygen-containing gas having a ratio λ (total) of 1 or more causes complete combustion, preventing the primary combustible gas and its partially decomposed products from being left in the reaction system. An oxygen-containing gas having a ratio λ (total) of 10 or less can avoid a significantly high combustion rate, resulting in a flame stably kept. Accordingly, a ratio λ (total) within this range is preferred.

The hydrolyzable raw material silicon compound as a starting raw material includes a hydrolyzable silicon compound converted into silica through a reaction with water. The raw material silicon compound may be introduced in the form of steam or in the form of a solution in an inert solvent unreactive with the raw material silicon compound. The raw material silicon compound is preferably introduced in the form of steam.

Examples of the raw material silicon compound include halogenated silicon, organic halogenated silicon, and silicon alkoxide. Specific examples thereof include $SiCl_4$, $MeSiCl_3$, $Me_2SiCl_2$, $Me_3SiCl$, $Me_4Si$, $HSiCl_3$, $Me_2HSiCl$, $MeEtSiCl_2$, $Cl_3SiSiMeCl_2$, $Cl_3SiSiMe_2Cl$, $Cl_3SiSiCl_3$, $MeCl_2SiSiMeCl_2$, $Me2ClSiSiMeCl_2$, $Me_2ClSiSiClMe_2$, $Me_3SiSiClMe_2$, $Me_3SiSiMe_3$, tetraethoxysilane, tetramethoxysilane, D4 polysiloxane (cyclic siloxane tetramer), and D5 polysiloxane (cyclic siloxane pentamer) (where Me represents methyl, and Et represents ethyl). These raw material silicon compounds may be used alone or in combination. Among these raw material silicon compounds, particularly preferred is $SiCl_4$.

The combustible gas reacts with oxygen to burn and simultaneously generate water necessary for hydrolysis of the raw material silicon compound. Examples of a preferred combustible gas (such as a primary combustible gas, or a secondary combustible gas, or a higher-order combustible gas) include hydrogen, methane, ethane, propane, butane, and natural gas. These combustible gases may be used alone or in combination. A particularly preferred combustible gas is hydrogen.

A preferred oxygen-containing gas (such as a primary oxygen-containing gas, a secondary oxygen-containing gas, or a tertiary or higher oxygen-containing gas) is air. Oxygen-enriched air can also be used.

In this process, the generated silica particles may be separated from the gaseous substance, and may be subjected to a steam treatment using steam and air of a mixed gas. The steam treatment is performed at a temperature of usually 250 to 750° C., preferably 300 to 700° C., more preferably 350 to 650° C., still more preferably 400 to 600° C., particularly preferably 450 to 550° C. The steam treatment is effective in removal of unreacted chlorides from the surfaces of the generated silica particles and a reduction in aggregated particles, for example. The steam treatment may be continuously performed on the silica particles after the separation of the gaseous substance, using steam and air of a mixed gas flowing in the co- or countercurrent direction.

<Surface Modification>

The silica particles according to the present invention may be prepared by the gas phase process as they are or surface-modified with a surface modifier (so-called surface treating agent).

The surface modification may be performed by the process described in WO2009/084184, for example, under a known condition for modifying the surfaces of the silica particles prepared by the gas phase process. In this case, while a silanol group reactive with the surface modifier is distributed in both the external surfaces and micropores of the silica particles, the surfaces of the silica particles cannot completely react with the surface modifier due to the steric hindrance. Accordingly, the necessary amount of the surface modifier is smaller than that usually calculated from the BET specific surface area of the silica particles prepared by the gas phase process, and can be set between the BET specific surface area and the statistical thickness surface area (STSA).

The surface modification can be performed by any process. For example, hydrophobization may be performed using any hydrophobizing agent. Examples thereof include alkylsilazane compounds, such as hexamethyldisilazane (HMDS); alkylalkoxysilane compounds, such as dimethyldimethoxysilane, dimethyldiethoxysilane, trimethylmethoxysilane, methyltrimethoxysilane, isobutyltrimethoxysilane, and decyltrimethoxysilane; chlorosilane compounds, such as dimethyldichlorosilane and trimethylchlorosilane; and silicone oil and silicone varnish. These hydrophobizing agents may be used alone or in combination.

Especially in the toner according to the present invention, the surfaces of the silica particles are preferably modified with compounds having a trimethylsilyl group (such as HMDS) or silicone oil. By use of the silica particles having surfaces modified with silicone oil, the silicone oil can be partially free on the fixed image, resulting in reduced adhesiveness of the image and increased image storage property.

Specific examples of the silicone oil surface modifier include organosiloxane oligomers; cyclic compounds, such as octamethylcyclotetrasiloxane, decamethylcyclopentasiloxane, tetramethylcyclotetrasiloxane, and tetravinyltetramethylcyclotetrasiloxane; and linear or branched organosiloxanes. Highly reactive silicone oil having a functional group introduced into one or two terminals of the side chain, and having at least a modified terminal may be used. Examples of the functional group include, but should not be limited to, alkoxy, carboxy, carbinol, higher fatty acid-modified, phenol, epoxy, methacrylic, and amino groups. Silicone oil having several functional groups, such as amino-/alkoxy-modified silicone oil, may be used.

A mixture or combination of dimethylsilicone oil, modified silicone oil thereof, and another surface modifier may be used. Examples of the surface modifier usable in the combination include silane coupling agents, titanate coupling agents, aluminate coupling agents, a variety of silicone oils, fatty acids, fatty acid metallic salts, esterified products thereof, and rosin acid.

Specific examples of the surface modification process include a process of spraying a hydrophobizing agent to the silica particles according to the present invention or mixing a vaporized hydrophobizing agent with the silica particles according to the present invention, and heat-treating the product. At this time, water, amine, and other catalysts may also be used. This dry surface modification is preferably performed under an atmosphere of an inert gas, such as nitrogen. Alternatively, a hydrophobizing agent is dissolved in a solvent, and the silica particles according to the present invention are mixed to be dispersed. The dispersion is heat-treated when necessary, and is further dried. Silica particles having modified surfaces can thereby be prepared. The hydrophobizing agent may be added after or concurrently with the mixing and dispersion of the silica particles in the solvent.

<Measurement of Primary Diameter of External Additive Particles>

The primary diameters of the silica particles and the titanium oxide particles (hereinafter, also collectively referred to as "external additive particles") can be determined as follows: An external additive is externally added (dispersed in) to the toner particles, the primary particles of the external additive are observed with a scanning electron microscope. From image analysis of each of the primary particles, its major axis diameter and minor axis diameter are measured. From this intermediate value, a sphere equivalent diameter is determined as the "primary particle diameter of the external additive".

The "major axis diameter" of an external additive particle refers to the length between two parallel lines at the longest interval contacting the contour of each external additive particle in the photographic image of the external additive particles photographed at a magnification of 40000x with a scanning electron microscope (SEM; for example, "JSM-7401F" (made by JEOL, Ltd.). The "minor axis diameter" refers to the length between parallel lines contacting the contour of the external additive particle and extending orthogonal to the parallel lines defining the major axis diameter.

<Measurement of Average Aspect Ratio of External Additive Particles>

The average aspect ratio of the external additive particles is determined as the ratio "(average major axis diameter)/(average minor axis diameter)" using the average major axis diameter and the average minor axis diameter. The average major axis diameter and the average minor axis diameter may be determined as follows: The number average major axis diameter and the number average minor axis diameter are measured in an electron microscopic photograph taken with a scanning electron microscope (SEM) "JSM-7401F" (made by JEOL, Ltd.), and are defined as the average major axis diameter and the average minor axis diameter.

<Measurement of Average Circularity of Secondary Particles>

The average circularity of the secondary particles can be measured as follows: For examples, a photographic image captured with a scanning electron microscope is read in with a scanner, and is subjected to image analysis with an image processing analyzer.

Specifically, the circle equivalent perimeters of the particles and the perimeters of the particles are determined from the analyzed image. The circularities of the external additive particles are determined from the following expression (1), and are averaged to determine the average circularity (similarly to the calculation of the average particle diameter).

$$\text{circularity}=(\text{circle equivalent perimeter of particle})/(\text{perimeter of particle})=[2\times(A\pi)^{1/2}]PM \quad \text{Expression (1):}$$

where A represents the projected area of an external additive particle, and PM represents the perimeter of the external additive particle. A circularity of 1.0 indicates a true sphere, and a circularity having a lower numeric value indicates that the particle has projections and depressions on its outer periphery and a higher degree of irregularity.

<Titanium Oxide Particles>

The toner according to the present invention preferably includes an external additive including titanium oxide particles having an average aspect ratio (average major axis diameter/average minor axis diameter) in the range of 3.0 to 15.0, more preferably 5.0 to 13.0, which is derived from the ratio of the average major axis diameter to the average minor axis diameter. The content of the titanium oxide particles is preferably in the range of 0.10 to 0.80 mass % relative to 100 mass % of the particulate toner matrix. If titanium oxide particles having an average aspect ratio of 3.0 to 15.0 are added, the titanium oxide particles function as a barrier, further reducing the migration of the large-diameter external additive into the depressions of the particulate toner matrix. In this embodiment, an average aspect ratio of 3.0 or more can suitably reduce the migration of the large-diameter external additive (such as the silica particles and titanium oxide particles) into the depressions of the particulate toner matrix. An average aspect ratio of 15.0 or less can prevent the detachment of the titanium oxide particles from the particulate toner matrix, suitably reducing the migration of the large-diameter external additive into the depressions of the particulate toner matrix. The average aspect ratio within this range is preferred because such an average aspect ratio can suitably reduce the migration of the large-diameter external additive into the depressions of the particulate toner matrix, and thus keep high image storage property after low coverage printing. The term "contained in the range of 0.10 to 0.80 mass % relative to 100 mass % of the particulate toner matrix" indicates that it is contained within the range of 0.10 to 0.80 parts by mass relative to the total mass of the particulate toner matrix contained in the electrostatic charge image developing toner.

The titanium oxide particles preferably have an average major axis diameter in the range of 30 to 70 nm. An average major axis diameter within this range can maximize the barrier function of the large-diameter external additive to prevent the migration of the titanium oxide particles into the depressions of the particulate toner matrix. Titanium oxide particles having an average major axis diameter of 30 nm or more can suitably function as the barrier. Titanium oxide particles having an average major axis diameter of 70 nm or less can prevent the detachment of the titanium oxide particles from the particulate toner matrix, suitably reducing the migration of the large-diameter external additive into the depressions of the particulate toner matrix.

The average major axis diameter of the titanium oxide particles within this range is preferred because such an average major axis diameter can suitably reduce the migration of the large-diameter external additive into the depressions of the particulate toner matrix, keeping high image storage property after low coverage printing.

The titanium oxide particles preferably contain titanium oxide having a rutile crystal structure (hereinafter, also referred to as "rutile titanium oxide"). The rutile titanium oxide has a higher calcination temperature and a smaller number of hydroxy groups on its surface than those of the anatase titanium oxide. Such characteristics of the rutile titanium oxide can prevent an increase in adhesive force of the particulate toner matrix caused by moisture adsorption, thus keeping high image storage property.

Hydrophobized titanium oxide particles are preferred. A known surface modifier (coupling agent) can be used in hydrophobization, and use of octyltrimethoxysilane is more preferred. In the titanium oxide particles modified with octyltrimethoxysilane as a surface modifier, their surfaces are modified with an octylsilyl group having a linear chain having eight carbon atoms, and are hydrophobized. In other words, the titanium oxide particles hydrophobized with octyltrimethoxysilane are covered with a linear carbon chain having eight carbon atoms, and are ideally fixed to the surface of the particulate toner matrix. For this reason, the titanium oxide particles uniformly stay on the surface of the toner matrix without migrating on the surface of the particulate toner matrix to be locally distributed. A preferred coupling agent has a linear alkyl group having six to ten carbon atoms. A coupling agent having six or more carbon atoms can have a sufficient length of carbon chain to stably fix the titanium oxide particles to the particulate toner matrix. A coupling agent having a linear alkyl group having ten or less carbon atoms can have a less bulky length of carbon chain without obstructing the progression of the coupling reaction with the titanium oxide particles, resulting in sufficient coverage of the titanium oxide particles with a surface modifying group. Other examples of the known surface modifier include those used in surface modification of silica particles.

<Other External Additives>

To improve the fluidity and the charging characteristics, the toner according to the present invention may also contain other external additives in addition to the silica particles and the titanium oxide particles according to the present invention within the range not inhibiting the advantageous effects. Examples of other external additives include fatty acid metals; and inorganic nanoparticles, such as inorganic oxide nanoparticles, such as silica nanoparticles having a particle diameter of less than 30 nm (small-diameter external additive), alumina nanoparticles, and titanium oxide nanoparticles; and inorganic titanic acid compound nanoparticles, such as strontium titanate and zinc titanate.

[Particulate Toner Matrix]

The particulate toner matrix according to the present invention includes a crystalline polyester resin as a binder resin. The particulate toner matrix according to the present invention may contain any internal additive, such as a colorant, besides the binder resin.

The particulate toner matrix may have a core-shell structure consisting of at least a core particle and a shell coating the surface of the core particle.

The core particle can contain the binder resin and an internal additive (such as a colorant) contained in the particulate toner matrix according to the present invention.

The shell can contain the binder resin contained in the particulate toner matrix according to the present invention and an internal additive. The shell preferably contains an amorphous polyester resin. Such a shell can keep high low-temperature off-setting resistance and high heat resistance of the toner.

The particulate toner matrix according to the present invention can contain any crystalline polyester resin as the binder resin. The particulate toner matrix according to the present invention preferably contains a binder resin other than the crystalline polyester resin. Specifically, a styrene-acrylic resin is preferably contained as the binder resin because it facilitates charge control of the toner. In this specification, the styrene-acrylic resin is prepared through addition polymerization of a polymerizable styrene monomer and a (meth)acrylate ester monomer. The styrene monomer includes styrene represented by the formula $CH_2{=}CH{-}C_6H_5$, and those having a styrene structure having a known side chain or functional group. In this specification, the (meth)acrylate ester monomer includes an acrylic acid ester represented by the formula $CH_2{=}CHCOOR$ (where R is an alkyl group), methacrylate esters, and esters having a structure of an acrylate ester derivative or a methacrylate ester derivative having a known side chain or functional group. Specific examples of the styrene monomers and (meth)acrylate ester monomers enabling formation of the styrene-acrylic resin will be shown below, but should not be limited to.

Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used alone or in combination.

Specific examples of the (meth)acrylate ester monomer include acrylate ester monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate esters, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

The content of the styrene-acrylic resin is preferably 70 mass % or more relative to the total amount of the binder resin. A content within this range can sufficiently enhance charging characteristics.

Besides the polymerizable monomers listed above, the polymerizable monomer may be a third polymerizable monomer. Examples of the third polymerizable monomer include acid monomers, such as acrylic acid, methacrylic acid, maleic anhydride, and vinylacetic acid; and acrylamide, methacrylamide, acrylonitrile, ethylene, propylene, butylene vinyl chloride, N-vinylpyrrolidone, and butadiene.

The polymerizable monomer may be a polyfunctional vinyl monomer. Examples of the polyfunctional vinyl monomer include diacrylates, such as ethylene glycol, propylene glycol, butylene glycol, and hexylene glycol; and dimethacrylates and trimethacrylates of tertiary or higher alcohols, such as divinylbenzene, pentaerythritol, and trimethylolpropane.

(Preparation of Styrene-Acrylic Resin)

The styrene-acrylic resin is preferably prepared by emulsion polymerization. In emulsion polymerization, polymerizable monomers, such as styrene and an acrylic acid ester, are dispersed in an aqueous medium described later, and are polymerized to prepare a styrene-acrylic resin. A surfactant is preferably used in the dispersion of the polymerizable monomers in the aqueous medium. Polymerization can be performed using a known polymerization initiator and chain transfer agent.

(Polymerization Initiator)

A variety of known polymerization initiators are suitably used. Specific examples thereof include peroxides, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, di-t-butyl peroxide, tetralin hydroperoxide, 1-phenyl-2-methylpropyl-1-hydroperoxide, tert-hydroperoxide pertriphenylacetate, tert-butyl performate, tert-butyl peracetate, tert-butyl perbenzate, tert-butyl perphenylacetate, tert-butyl permethoxyacetate, and tert-butyl per-N-(3-toluyl)palmitate; and azo compounds, such as 2,2'-azobis(2-aminodipropane) hydrochloride, 2,2'-azobis-(2-aminodipropane) nitrate, 1,1'-azobis-(sodium 1-methylbutyronitrile-3-sulfonate), 4,4'-azobis-4-cyanovaleric acid, and poly(tetraethylene glycol-2,2'-azobisisobutyrate).

(Chain Transfer Agent)

Any chain transfer agent can be used, and examples thereof include mercaptans, such as octyl mercaptan, dodecyl mercaptan, alkyl mercaptan, and t-dodecyl mercaptan; mercaptopropionic acids, such as n-octyl-3-mercaptopropionate and stearyl-3-mercaptopropionate; and mercapto-fatty acid esters and styrene dimers. These chain transfer agents can be used alone or in combination.

<Crystalline Polyester Resin>

The term "crystallinity" of a crystalline polyester resin indicates that the resin has a clear endothermic peak in differential scanning calorimetry (DSC) rather than a stepwise endothermic curve, specifically, a half width of the endothermic peak within 10° C. measured at a heating rate of 10° C./min. Resins having a half width of more than 10° C., having a stepwise endothermic curve, or having no clear endothermic peak are defined as amorphous polyester resin (amorphous polymer).

The crystalline polyester resin can be prepared by a standard polymerization process for polyester through a reaction of an acid component with an alcohol component. Examples of the polymerization process include direct polycondensation and transesterification. The polymerization process is appropriately used according to the type of monomers, for example.

The crystalline polyester resin can be prepared at a polymerization temperature of 180 to 230° C., for example. The monomers described above are reacted while the condensation products, water and alcohol, are being removed and the inner pressure of the reaction system is reduced when necessary. If the monomers are not dissolved or compatibilized under the reaction temperature, a solubilizing aid solvent having a high boiling point may be added to dissolve the monomers. The polycondensation reaction is performed while the solubilizing aid solvent is being distilled off. In the copolymerization reaction using a monomer having low compatibility, for example, the monomer having low compatibility may be preliminarily condensed with an acid or alcohol to be polycondensed with the monomer, and then may be polycondensed with the main component.

Any other binder resin can be contained. Examples thereof include styrene-(meth)acrylic resins, polyester resins, and partially modified polyester resins.

The crystalline polyester resin specifically has a molecular structure of a condensation polymerization product prepared from a polyvalent carboxylic acid (acid component) and a polyhydric alcohol (alcohol component). For example, the crystalline polyester resin can be synthesized through condensation polymerization of these components.

These polyvalent carboxylic acids may be used alone or in combination. Examples of the polyvalent carboxylic acid include aliphatic dicarboxylic acids, aromatic dicarboxylic acids, dicarboxylic acids having double bonds, trivalent or higher-valent carboxylic acids, anhydrides thereof, and lower alkyl esters thereof. The dicarboxylic acids having double bonds suitably prevent hot off-setting during fixing of the toner particles because these dicarboxylic acids form radical crosslinks through the double bonds.

Examples of the aliphatic dicarboxylic acids used in synthesis of the crystalline polyester resin include oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid.

Examples of the aromatic dicarboxylic acids used in synthesis of the crystalline polyester resin include phthalic acid, isophthalic acid, terephthalic acid, naphthalene-2,6-dicarboxylic acid, malonic acid, and mesaconic acid.

Examples of the dicarboxylic acids having double bond include maleic acid, fumaric acid, 3-hexenedioic acid, and 3-octenedioic acid. Among these dicarboxylic acids, preferred are fumaric acid and maleic acid in view of cost.

Examples of the trivalent or higher carboxylic acids include 1,2,4-benzenetricarboxylic acid, 1,2,5-benzenetricarboxylic acid, and 1,2,4-naphthalenetricarboxylic acid.

One or more polyhydric alcohols may be used for synthesis of the crystalline polyester resin. Examples of the polyhydric alcohols include aliphatic diols and trihydric or higher-hydric alcohols. Among these polyhydric alcohols, preferred are aliphatic diols to prepare a crystalline polyester resin described later, and more preferred are linear aliphatic diols having a main chain having 7 to 20 carbon atoms.

Use of the linear aliphatic diol maintains the crystallinity of polyester, preventing a reduction in melting point of the polyester. Accordingly, the linear aliphatic diols are preferred to prepare a two-component developer having high toner blocking resistance, high image storage property, and high low-temperature fixing characteristics. Linear aliphatic diols having a main chain having 7 to 20 carbon atoms are preferred because such linear aliphatic diols yield products having a low melting point during condensation polymerization with the aromatic dicarboxylic acid, and achieve low-temperature fixing. These linear aliphatic diols are practically preferred because of their availability of the materials. In such viewpoints, linear aliphatic diols having a main chain having 7 to 14 are more preferred.

Examples of the aliphatic diols suitably used in synthesis of the crystalline polyester resin include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13 -tridecanediol, 1,14-tetradecanediol, 1,18-octadecanediol, and 1,14-eicosandecanediol. Among these aliphatic diols, preferred is 1,8-octanediol, 1,9-nonanediol or 1,10-decanediol because of their availability.

Examples of the trihydric or higher-hydric alcohols include glycerol, trimethylolethane, trimethylolpropane, and pentaerythritol.

A chain transfer agent may be added to the monomer components used for synthesis of the crystalline polyester resin to adjust the molecular weight of the resin. One or more chain transfer agents may be used in an amount within the range providing the advantageous effects of the present embodiment to achieve the object of the present invention. Examples of the chain transfer agent include 2-chloroethanol; mercaptans, such as octyl mercaptan, dodecyl mercaptan, and t-dodecyl mercaptan; and styrene dimers.

(Hybrid Crystalline Polyester Resin)

The particulate toner matrix according to the present invention preferably contains, as the crystalline polyester resin, a hybrid crystalline polyester resin prepared through chemical bond of at least a crystalline polyester polymer segment and another polymer segment (hereinafter, also referred to as "second polymer segment A"). Such a hybrid crystalline polyester resin can reduce low-temperature off-setting.

The second polymer segment A indicates a polymer segment different from the polyester polymer segment. The hybrid crystalline polyester resin may contain any polymer segment. The polymer segment is preferably an amorphous polymer segment. Such a hybrid resin can have affinity for the amorphous resin adjusted such that the crystalline resin is homogeneously nanodispersed in the amorphous resin.

In the hybrid crystalline polyester resin, a resin moiety having a structure derived from the crystalline polyester resin is referred to as a crystalline polyester polymer segment, and a resin moiety having a structure derived from an amorphous resin is referred to as an amorphous polymer segment.

The hybrid crystalline polyester resin can have sufficient crystallinity because the amorphous polymer segment of the hybrid crystalline polyester resin has having high affinity for the amorphous resin forming a matrix phase and chains of the crystalline polymer segment thereof are readily aligned.

The content of the crystalline polyester polymer segment in the hybrid crystalline polyester resin is preferably in the range of 50 to 98 mass % to give sufficient crystallinity to the hybrid crystalline polyester resin.

The components and contents of the crystalline polyester polymer segment and the second polymer segment in the hybrid crystalline polyester resin can be determined by NMR analysis or methylation reaction pyrolysis gas chromatography/mass spectrometry (pyrolysis gas chromatography mass spectrometry, Py-GC/MS), for example.

Any amorphous polymer segment having non-crystallinity can be used. Examples thereof include amorphous polyester polymer segments, amorphous vinyl polymer segments, amorphous urethane polymer segments, and amorphous urea polymer segments. Among these amorphous polymer segments, an amorphous polymer segment having a structure derived from the amorphous resin used as the binder resin, such as an amorphous polyester resin, can have increased compatibility with the amorphous resin forming the matrix phase, resulting in charge uniformity.

The content of the second polymer segment A in the hybrid crystalline polyester resin can be in the range of 40 to 60 mass %, preferably 45 to 50 mass %.

Examples of the process of synthesizing the hybrid crystalline polyester resin include the following processes (1) to (3). In the processes (1) to (3), the second polymer segment A is an amorphous polymer segment.

(1) A process of reacting a crystalline polyester resin preliminarily prepared with a bireactive monomer, and then reacting the reaction product with a raw material monomer for the amorphous resin to form chemical bonds of crystalline polyester polymer segments and amorphous polymer segments.

(2) A process of reacting an amorphous resin preliminarily prepared with a bireactive monomer, and then reacting the reaction product with raw materials for the crystalline polyester resin, i.e., a polyvalent carboxylic acid monomer and a polyhydric alcohol monomer to form chemical bonds of amorphous polymer segments and crystalline polyester polymer segments.

(3) A process of reacting a crystalline polyester resin and an amorphous resin preliminarily prepared with a bireactive monomer to form chemical bonds of the reaction products as segments.

The bireactive monomer bonds the crystalline polyester resin to the amorphous resin, and the molecule thereof has a substituent, such as a hydroxy, carboxy, epoxy, primary amino, or secondary amino group, reactive with the crystalline polyester resin, and an ethylenically unsaturated group reactive with the amorphous resin. Among these bireactive monomers, preferred is vinylcarboxylic acid having a hydroxy or carboxy group and an ethylenically unsaturated group.

A bireactive monomer usable is (meth)acrylic acid, fumaric acid, or maleic acid, for example. A hydroxyalkyl (one to three carbon atoms) ester of (meth)acrylic acid, fumaric acid, or maleic acid may be used. Preferred is acrylic acid, methacrylic acid, or fumaric acid in view of the reactivity.

The amount of the bireactive monomer to be used is in the range of preferably 1 to 10 parts by mass, more preferably 4 to 8 parts by mass relative to the total amount (100 parts by mass) of the monomers used in the formation of the amorphous polymer segment to enhance the low-temperature fixing characteristics, hot off-setting resistance, and durability of the toner.

The crystalline polyester resin has a melting point ($T_m$) in the range of preferably 55 to 90° C., more preferably 70 to 85° C. to provide sufficient low-temperature fixing characteristics and high hot off-setting resistance.

The melting point of the crystalline polyester resin can be controlled by the resin composition.

The melting point ($T_m$) is an endothermic peak temperature which can be measured by DSC.

Specifically, a sample is placed into an aluminum pan (KIT No. B0143013), and the pan is sealed. The pan is placed on a sample holder of thermal analyzer Diamond DSC (made by PerkinElmer Inc.) to vary the temperature by heating, cooling, and heating cycles in this order. The sample is heated from room temperature (25° C.) in the first heating cycle and 0° C. in the second heating cycle to 150° C. at a heating rate of 10° C./min, and is kept at 150° C. for five minutes. In the cooling cycle, the sample is cooled from 150° C. to 0° C. at a cooling rate of 10° C./min, and is kept at a temperature of 0° C. for five minutes. The endothermic peak temperature in the endothermic curve observed during the second heating is defined as a melting point.

<Amorphous Polyester Resin>

Examples of the amorphous polyester resin include polymers prepared through condensation of a polyvalent carboxylic acid and a polyhydric alcohol. The amorphous polyester resin may be a commercially available product or a synthetic product.

Similar to the crystalline polyester resin, the amorphous polyester resin may contain another binder resin. Examples thereof include styrene-(meth)acrylic resins, polyester resins, and partially modified polyester resins.

The styrene-(meth)acrylic resins have a molecular structure of a radical polymer derived from a compound having a radically polymerizable unsaturated bond, and can be prepared by radical polymerization of the compound, for example. One or more compounds described above can be used. Examples thereof include styrene and derivatives thereof, and (meth)acrylic acid and derivatives thereof.

Examples of the styrene and derivatives thereof include styrene and derivatives thereof identical to those listed in the crystalline polyester resin.

Examples of the (meth)acrylic acid and derivatives thereof include (meth)acrylic acid and derivatives thereof identical to those listed in the crystalline polyester resin.

Examples of the polyvalent carboxylic acid used in synthesis of the amorphous polyester resin include aromatic carboxylic acids, such as terephthalic acid, isophthalic acid, phthalic anhydride, trimellitic anhydride, pyromellitic acid, and naphthalenedicarboxylic acid; aliphatic carboxylic acids, such as maleic anhydride, fumaric acid, succinic acid, alkenylsuccinic anhydride, and adipic acid; alicyclic carboxylic acid, such as cyclohexanedicarboxylic acid; and anhydrides thereof and lower (in the range of one to five carbon atoms) alkyl esters thereof. Among these polyvalent carboxylic acids, desired are aromatic carboxylic acids.

The polyvalent carboxylic acid used in the synthesis of the amorphous polyester resin may be a combination of a dicarboxylic acid with a trivalent or higher-valent carboxylic acid having a crosslinked or branched structure (such as trimellitic acid or an acid anhydride thereof) to ensure fixing characteristics.

These polyvalent carboxylic acids may be used alone or in combination.

Examples of the polyhydric alcohols used for synthesis of the amorphous polyester resin include aliphatic diols, such as ethylene glycol, diethylene glycol, triethylene glycol, propylene glycol, butanediol, hexanediol, neopentyl glycol, and glycerol; alicyclic diols, such as cyclohexanediol, cyclohexanedimethanol, and hydrogenated bisphenol A; and aromatic diols, such as ethylene oxide adducts of bisphenol A, and propylene oxide adducts of bisphenol A.

Among these polyhydric alcohols used for synthesis of the amorphous polyester resin, desired are aromatic diols and alicyclic diols, more desired are aromatic diols.

The polyhydric alcohol used for synthesis of the amorphous polyester resin is preferably a combination of a diol with a trivalent or higher-valent polyhydric alcohol (glycerol, trimethylolpropane, or pentaerythritol) having a crosslinked or branched structure to ensure the fixing characteristics of the toner.

These polyhydric alcohols used for synthesis of the amorphous polyester resin may be used alone or in combination.

(Hybrid Amorphous Polyester Resin)

The amorphous polyester resin contained in the particulate toner matrix according to the present invention may be a hybrid amorphous polyester resin prepared through chemical bond of at least an amorphous polyester polymer segment and a third polymer segment (hereinafter, also referred to as "third polymer segment B"). In particular, in a particulate toner matrix having a core-shell structure, the shell preferably contains such a hybrid amorphous polyester resin to keep higher low-temperature off-setting resistance and higher image storage property.

In the hybrid amorphous polyester resin, the resin moiety having a structure derived from the amorphous polyester resin is referred to an amorphous polyester polymer segment. The third polymer segment B indicates a polymer segment different from the polyester polymer segment. The hybrid amorphous polyester resin can contain any third polymer segment B. A preferred third polymer segment B is a styrene-acrylic polymer segment. The styrene-acrylic polymer segment refers to the resin moiety derived from the styrene-acrylic resin, or the chain having the same chemical structure as that of the styrene-acrylic resin in the hybrid amorphous polyester resin.

The content of the styrene-acrylic polymer segment in the hybrid amorphous polyester resin is preferably in the range of 1 to 30 mass % because control of the plasticity of the toner particles is facilitated.

The third polymer segment B may be any segment derived from a resin other than the amorphous polyester resin. Examples thereof include amorphous vinyl polymer segments, amorphous urethane polymer segments, and amorphous urea polymer segments.

The hybrid amorphous polyester resin can be synthesized by one of the processes (1) to (3) for synthesizing the hybrid crystalline polyester resin except that the crystalline polyester resin or the crystalline polyester polymer segment is replaced with the amorphous polyester resin or the amorphous polyester polymer segment and the amorphous polymer segment is a vinyl polymer segment.

The hybrid amorphous polyester resin more preferably has a weight average molecular weight (Mw) in the range of 2000 to 10000 in view of the fixing characteristics of the toner.

The amorphous polyester resin preferably has a glass transition temperature ($T_g$) in the range of 20 to 70° C. The glass transition temperature ($T_g$) can be measured according to a procedure specified in ASTM (Standards of American Society for Testing and Materials) D3418-82 (DSC method). The measurement can be performed with a differential scanning calorimeter "DSC 8500" (made by PerkinElmer Inc.).

The glass transition temperature ($T_g$) of the amorphous polyester resin can be controlled by the resin composition.

It should be noted that the particulate toner matrix according to the present invention may contain internal additives, such as a colorant, a charge control agent, and a mold release agent.

The particulate toner matrix according to the present invention preferably has an average circularity in the range of 0.945 to 0.965. An average circularity of 0.945 or more can decrease the depressions of the particulate toner matrix, reducing the migration of the external additive into the depressions of the particulate toner matrix, and thus keeping high image storage property after low coverage printing. An average circularity of 0.965 or less yields a particulate toner matrix having a moderate circularity, reducing the detachment of the external additive, and keeping high image storage property after low coverage printing.

(Average Circularity of Particulate Toner Matrix)

The average circularity of the particulate toner matrix can be measured with "FPIA-2100" (made by Sysmex Corporation), for example. Specifically, a sample (toner) is mixed with an aqueous solution containing a surfactant, and is ultrasonically dispersed for one minute. The sample is photographed with "FPIA-2100" in a high power field (HPF) mode at an appropriate density (the number of particles to be detected at an HPF: 3000 to 10000 particles). The circularities of the photographed particulate toner matrices are calculated from the following expression. The circularities of the particulate toner matrices are added, and the total is divided by the total number of particulate toner matrices to give the average circularity of the particulate toner matrix. A number of particles to be detected at an HPF within this range can provide reproductivity in the measurement.

circularity=(perimeter of circle having projected area identical to that of particle image)/(perimeter of projected image of particle)

<Colorant>

The toner according to the present invention can contain a colorant. A known colorant can be used.

Specific examples of the colorant contained in the yellow toner include C.I. Solvent Yellows 19, 44, 77, 79, 81, 82, 93, 98, 103, 104, 112, and 162; and C.I. Pigment Yellows 14, 17, 74, 93, 94, 138, 155, 180, and 185. These colorants may be used alone or in combination. Among these colorants, more preferred is C.I. Pigment Yellow 74.

The content of the colorant contained in the yellow toner is preferably 1 to 10 parts by mass, more preferably 2 to 8 parts by mass relative to 100 parts by mass of the binder resin.

Specific examples of the colorant contained in the magenta toner include C.I. Solvent Reds 1, 49, 52, 58, 63, 111, and 122; and C.I. Pigment Reds 5, 48:1, 53:1, 57:1, 122, 139, 144, 149, 166, 177, 178, and 222. These colorants may be used alone or in combination. Among these colorants, more preferred is C.I. Pigment Red 122.

The content of the colorant contained in the magenta toner is preferably 1 to 10 parts by mass, more preferably 2 to 8 parts by mass relative to 100 parts by mass of the binder resin.

Specific examples of the colorant contained in the cyan toner include C.I. Pigment Blue 15:3.

The content of the colorant contained in the cyan toner is preferably 1 to 10 parts by mass, more preferably 2 to 8 parts by mass relative to 100 parts by mass of the binder resin.

Specific examples of the colorant contained in the black toner include carbon black, magnetic substances, and titanium black. Examples of carbon black include channel black, furnace black, acetylene black, thermal black, and lamp black. Examples of the magnetic substances include ferromagnetic metals, such as iron, nickel, and cobalt; alloys containing these ferromagnetic metals; compounds of ferromagnetic metals, such as ferrite and magnetite; and alloys containing no ferromagnetic metal but demonstrating ferromagnetism through a heat treatment. Examples of the alloys demonstrating ferromagnetism through a heat treatment include Heusler alloys, such as manganese-copper-aluminum and manganese-copper-tin; and chromium dioxide.

The content of the colorant contained in the black toner is preferably 1 to 10 parts by mass, more preferably 2 to 8 parts by mass relative to 100 parts by mass of the binder resin.

Besides the binder resin, the colorant, and the external additive described above, the toner according to the present invention may further contain internal additives, such as a charge control agent and a mold release agent, and any other external additive when necessary.

<Charge Control Agent>

Any charge control agent which can positively or negatively charge the toner by frictional charging can be used; examples thereof include a variety of known positive charge controllers and negative charge controllers.

The content of the charge control agent is preferably 0.01 to 30 parts by mass, more preferably 0.1 to 10 parts by mass relative to 100 parts by mass of the binder resin.

<Mold Release Agent>

The mold release agent to be used is a variety of known waxes.

Examples of the wax include polyolefin waxes, such as polyethylene wax and polypropylene wax; branched hydrocarbon waxes, such as microcrystalline wax; long-chain hydrocarbon waxes, such as paraffin wax and SASOL wax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediamine behenylamide and trimellitic acid tristearylamide.

The content of the mold release agent is preferably 0.1 to 30 parts by mass, more preferably 1 to 10 parts by mass relative to 100 parts by mass of the binder resin.

<<Developer>>

While the electrostatic charge image developing toner according to the present invention may be used in the form of a magnetic or non-magnetic one-component developer, the electrostatic charge image developing toner may be mixed with carrier particles and used in the form of a two-component developer. In the toner in the form of a two-component developer, the carrier particles to be used may be magnetic particles composed of a known material, such as a metal (such as iron, ferrite, or magnetite) or an alloy thereof with a metal (such as aluminum or lead). More preferred are ferrite particles.

[Carrier Particles]

The carrier particles are composed of a magnetic substance. The carrier particles may also be resin-coated carrier particles composed of core material particles of the magnetic substance coated with a resin (hereinafter, also referred to as "carrier coating resin"), or may be resin-dispersed carrier particles containing magnetic substance nanoparticles dispersed in a resin. Preferred are the resin-coated carrier particles to control the true density to be 4.25 to 5 g/cm$^3$ and the porosity to be 8% or less.

The carrier particles may contain an internal additive, such as a resistance adjuster, when necessary.

<Core Material Particles>

The core material particles forming the carrier particles are composed of metal powder, such as iron powder, or a variety of ferrites. Among these materials, preferred is ferrite.

Preferred ferrites are ferrites containing a heavy metal, such as copper, zinc, nickel, or manganese, and light metal ferrites containing an alkali metal or an alkaline earth metal.

The ferrite is a compound represented by the formula $(MO)\times(Fe_2O_3)_y$, where the molar ratio $\gamma$ of $Fe_2O_3$ in the ferrite is preferably 30 to 95 mol %. A ferrite having a molar ratio within this range is readily desirably magnetized, leading to a merit such that a carrier preventing adhesion can be prepared. In the formula, M represents a metal atom, such as manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co), or lithium (Li). These metal atoms may be used alone or in combination.

<Carrier Coating Resin>

Use of an alicyclic methacrylate ester having high hydrophobicity as a monomer for preparing a carrier coating resin decreases the content of the moisture absorbed on the carrier particles, and reduces the environmental variations in charging characteristics, preventing a reduced charging amount particularly under an environment at a high temperature and a high humidity. This resin prepared through polymerization of a monomer containing an alicyclic methacrylate ester has appropriate mechanical strength, and the coating film of such a resin is appropriately worn. The surfaces of the carrier particles are thereby refreshed.

Preferred alicyclic methacrylate esters are those having a cycloalkyl group having five to eight carbon atoms. Specific examples thereof include cyclopentyl methacrylate, cyclohexyl methacrylate, cycloheptyl methacrylate, and cyclooctyl methacrylate. Among these methacrylates, more preferred is cyclohexyl methacrylate in view of its mechanical strength and the environmental stability of the charging amount.

<Average Thickness of Carrier Coating Resin>

The carrier coating resin in the carrier particles has an average thickness in the range of preferably 0.05 to 4.0 μm, more preferably 0.2 to 3.0 μm in view of the compatibility between the durability of the carrier and the reduced electric resistance thereof.

An average thickness of the carrier coating resin within this range can control the charging characteristics and the durability to fall within preferred ranges.

<Magnetization of Carrier Particles>

The carrier particles preferably have a saturation magnetization in the range of 30 to 75 $Am^2/kg$ and a residual magnetization of 5.0 $Am^2/kg$ or less.

Use of carrier particles having such magnetic characteristics can prevent partial aggregation of the carrier particles, and enables homogeneous dispersion of the two-component developer on the surface of a developer carrier, forming uniform, high-definition toner images without unevenness of the density.

<<Image Forming Apparatus>>

The toner according to the present invention can be suitably used in standard electrophotographic image forming apparatuses. Specifically, the toner can be suitably used in an image forming apparatus 1 according to Japanese Patent Application Laid-Open No. 2014-240923 illustrated in FIG. 1. In this specification, FIG. 1 illustrates the image forming apparatus 1 or a color image forming apparatus of an intermediate transfer mode using electrophotographic techniques. The image forming apparatus 1 employs a vertical tandem system including photoreceptor drums 413 corresponding to four colors of cyan (C), magenta (M), yellow (Y), and black (K) disposed in series in the traveling direction (vertical direction) of an intermediate transfer belt 421 where toner images of the four colors are sequentially transferred onto the intermediate transfer belt 421 by one operation.

In other words, the image forming apparatus 1 transfers (primarily transfers) the toner images of the four colors of Y, M, C, and K formed on the photoreceptor drums 413, respectively, onto the intermediate transfer belt 421 to overlay the toner images of the four colors on the intermediate transfer belt 421, and then transfers (secondarily transfers) the overlaid image onto a sheet to form an image.

As illustrated in FIG. 1, the image forming apparatus 1 preferably includes an image reader 10, an operational display 20, an image processor 30, an image forming unit 40, a sheet conveying unit 50, a fixing unit 60, and a controller 100.

The above-mentioned embodiments should not be construed to limit the present invention and may be appropriately modified within the scope of the present invention.

EXAMPLES

The present invention will now be described in detail by way of non-limiting Examples. In Examples, "parts" and "%" are on the mass basis, unless otherwise specified.

<<Preparation of Toner>>

<Preparation of Particulate Toner Matrix 1>

(1) Preparation of Colorant Nanoparticle Dispersion (1)

Sodium n-dodecylsulfate (11.5 parts by mass) was dissolved in deionized water (160 parts by mass) with stirring to prepare a solution. While the solution was being stirred, copper phthalocyanine (24.5 parts by mass) was gradually added to the solution. In the next step, the mixture was dispersed with a stirrer "Cleamix W Motion CLM-0.8" (made by M Technique Co., Ltd.) to prepare "Colorant nanoparticle dispersion (1)" containing colorant nanoparticles having a volume-based median diameter of 126 nm.

(2) Preparation of Styrene-Acrylic Resin Nanoparticle Dispersion (A)

First Polymerization: Preparation of Dispersion of "Resin Nanoparticle (a)"

An anionic surfactant solution of an anionic surfactant "sodium laurylsulfate" (2.0 parts by mass) in deionized water (2900 parts by mass) was placed into a reactor equipped with a stirrer, a temperature sensor, a temperature controller, a cooling tube, and a nitrogen inlet, and the reactor was heated to an inner temperature of 80° C. while the solution was being stirred under a nitrogen stream at a stirring rate of 230 rpm. A polymerization initiator "potassium persulfate (KPS)" (9.0 parts by mass) was added to the anionic surfactant solution, and the internal temperature was controlled to be 78° C. Subsequently, Monomer solution (1) including styrene (540 parts by mass), n-butyl acrylate (270 parts by mass), methacrylic acid (65 parts by mass), and n-octylmercaptan (17 parts by mass) was added dropwise into the anionic surfactant solution over three hours. After completion of the addition, the reaction solution was heated at 78° C. over one hour with stirring to perform polymerization (first polymerization). A dispersion of "Resin nanoparticle (a)" was thereby prepared.

Second Polymerization: Formation of Intermediate Layer (Preparation of Dispersion of "Resin Nanoparticle (b)")

In a flask equipped with a stirrer, a mold release agent or paraffin wax (melting point: 73° C.) (51 parts by mass) was added to a monomer solution including styrene (94 parts by mass), n-butyl acrylate (60 parts by mass), methacrylic acid (11 parts by mass), and n-octylmercaptan (5 parts by mass), and was dissolved by heating to 85° C. to prepare Monomer solution (2).

A surfactant solution of an anionic surfactant "sodium laurylsulfate" (2 parts by mass) in deionized water (1100 parts by mass) was heated to 90° C. The dispersion of "Resin nanoparticle (a)" (solid content of "Resin nanoparticle (a)":

28 parts by mass) was added to the surfactant solution. Subsequently, Monomer solution (2) was dispersed for four hours with a mechanical dispersing machine "Cleamix" (made by M Technique Co., Ltd.) having a circulating path to prepare a dispersion containing emulsified particles having a diameter of 350 nm. A solution of a polymerization initiator "KPS" (2.5 parts by mass) in deionized water (110 parts by mass) was dissolved in this dispersion to prepare an initiator aqueous solution. The initiator aqueous solution was added to the surfactant solution containing the dispersion of "Resin nanoparticle (a)". This system was stirred at 90° C. over two hours to perform polymerization (second polymerization). A dispersion of "Resin nanoparticle (b)" was thereby prepared.

Third Polymerization: Formation of Outer Layer (Preparation of "Styrene-Acrylic Resin Particle Dispersion")

An initiator aqueous solution of a polymerization initiator "KPS" (2.5 parts by mass) in deionized water (110 parts by mass) was added to the dispersion of "Resin nanoparticle (b)". Monomer solution (3) including styrene (220 parts by mass), n-butyl acrylate (110 parts by mass), methacrylic acid (15 parts by mass), and n-octylmercaptan (5.2 parts by mass) was added dropwise at 80° C. over one hour. After completion of the addition, the reaction solution was stirred with heating over three hours to perform polymerization (third polymerization). In the next step, the reaction solution was cooled to 28° C. to prepare "Styrene-acrylic resin nanoparticle dispersion (A)".

(3) Preparation of Crystalline Polyester Resin Nanoparticle Dispersion [2]

(3-1) Synthesis of Crystalline Polyester Resin

Ten aliquots of 1,6-hexanediol (118 parts by mass), tetradecanedioic acid (271 parts by mass), and a polycondensation catalyst titanium tetraisopropoxide (0.8 parts by mass) were stepwise placed into a reaction tank equipped with a cooling tube, a stirrer, and a nitrogen inlet pipe, and were reacted for five hours at 235° C. under a nitrogen stream while a product water was being distilled off. In the next step, a reaction was performed under a reduced pressure of 13.3 kPa (100 mmHg) for one hour to synthesize a crystalline polyester resin.

(3-2) Preparation of Crystalline Polyester Resin Particle Dispersion

The resulting polyester resin (100 parts by mass) was pulverized with "Roundel Mill RM" (made by TOKUJU CORPORATION), and was mixed with a solution (638 parts by mass) of 0.26 mass % sodium laurylsulfate preliminarily prepared. The mixed solution was ultrasonically dispersed at a V-level and 300 μA for 30 minutes under stirring with an ultrasonic homogenizer "US-150T" (made by NIHONSEIKI KAISHA LTD.) to prepare Crystalline polyester resin nanoparticle dispersion [2] having a volume-based median diameter (D50) of 200 nm.

(4) Preparation of Particulate Toner Matrix

<Preparation of Particulate Toner Matrix 1>

"Styrene-acrylic resin nanoparticle dispersion (A)" (solid content: 250 parts by mass), Crystalline polyester resin nanoparticle dispersion [2] (solid content: 50 parts by mass), and deionized water (2000 parts by mass) were placed into a reactor equipped with a stirrer, a temperature sensor, and a cooling tube, and an aqueous solution of 5 mol/L sodium hydroxide was added to adjust the pH to 10 (solution temperature: 25° C.). Colorant nanoparticle dispersion (1) was then added (solid content: 40 parts by mass). In the next step, an aqueous solution of magnesium chloride (60 parts by mass) in deionized water (60 parts by mass) wad added over ten minutes under stirring at 30° C. The system was left to stand for three minutes, and then was heated over 60 minutes to 80° C. While the system was kept at 80° C., a particle growth reaction was continued. In this state, the diameters of associated particles were measured with "Multisizer 3" (made by Beckman Coulter, Inc. When the volume-based median diameter (D50) reached 6.5 μm, an aqueous solution of sodium chloride (190 parts by mass) in deionized water (760 parts by mass) was added to terminate the growth of the particles. The system was further heated at 90° C. under stirring to fuse the particles. When the average circularity of the particulate toner matrix measured with an analyzer "FPIA-2100" (made by Sysmex Corporation) (the number of particles to be detected at a HPF: 4000 particles) reached 0.955, the system was cooled to 30° C. to prepare a dispersion of a particulate toner matrix.

The dispersion of the particulate toner matrix was subjected to solid liquid separation with a centrifuge to extract a wet cake of the particulate toner matrix. The wet cake was centrifugally washed with deionized water at 35° C. until the filtrate had an electric conductivity of 5 μS/cm, and then was placed into a "flash jet dryer" (made by Seishin Enterprise Co., Ltd.) to dry the wet cake until the moisture content reached 0.5 mass %. Particulate toner matrix 1 was thereby prepared.

<Preparation of Particulate Toner Matrices 2 to 5>

Particulate toner matrices 2 to 5 were prepared as in Particulate toner matrix 1 except that the average circularity was varied as shown in Table 1 through control of the time to fuse particles.

<Preparation of Particulate Toner Matrix 6>

Particulate toner matrix [6] was prepared as in "(4) Preparation of particulate toner matrix" in Preparation of Particulate toner matrix 1 except that Crystalline polyester resin nanoparticle dispersion [2] was replaced with Hybrid (vinyl-modified) crystalline polyester resin nanoparticle dispersion [3].

(5) Preparation of Hybrid Crystalline Polyester Resin Nanoparticle Dispersion [3]

(5-1) Synthesis of Vinyl-Modified Crystalline Polyester Resin

Into a 10-L four-necked flask equipped with a nitrogen inlet pipe, a dehydration tube, a stirrer, and a thermocouple were placed tetradecanedioic acid (271 parts by mass), 1,6-hexanediol (118 parts by mass), and titanium tetraisopropoxide (0.8 parts by mass), and the mixture was subjected to a condensation polymerization reaction at 230° C. for eight hours. These materials were further reacted at 8 kPa for one hour, and were cooled to 160° C. A mixture of acrylic acid (8.6 parts by mass), styrene (131 parts by mass), butyl acrylate (30 parts by mass), and a polymerization initiator (di-t-butyl peroxide) (10 parts by mass) was then added dropwise over one hour from a dropping funnel. After the addition, an addition polymerization reaction was continued for one hour while the system was kept at 160° C. The system was then heated to 200° C., and was kept at 10 kPa for one hour. Acrylic acid, styrene, and butyl acrylate were then removed to prepare a hybrid crystalline polyester resin.

(5-2) Preparation of Hybrid Crystalline Polyester Resin Particle Dispersion

The hybrid crystalline polyester resin (100 parts by mass) was pulverized with "Roundel Mill RM" (made by TOKUJU CORPORATION), and was mixed with a solution (638 parts by mass) of 0.26 mass % sodium laurylsulfate preliminarily prepared. The hybrid crystalline polyester resin was ultrasonically dispersed at a V-level and 300 μA for 30 minutes under stirring with an ultrasonic homogenizer "US-150T" (made by NIHONSEIKI KAISHA LTD.) to prepare Hybrid crystalline polyester resin nanoparticle dispersion [3] containing a hybrid crystalline polyester resin nanoparticle having a volume-based median diameter (D50) of 170 nm.

<Preparation of Particulate Toner Matrix 7>

"Styrene-acrylic resin nanoparticle dispersion (A)" (solid content: 250 parts by mass), Hybrid crystalline polyester resin nanoparticle dispersion [3] (solid content: 50 parts by mass), Mold release agent dispersion [B] (solid content: 25 parts by mass), and deionized water (2000 parts by mass) were placed into a reactor equipped with a stirrer, a temperature sensor, and a cooling tube, and an aqueous solution of 5 mol/L sodium hydroxide was added to adjust the pH to 10. Colorant nanoparticle dispersion (1) was then added (solid content: 40 parts by mass). In the next step, an aqueous solution of magnesium chloride (60 parts by mass) in deionized water (60 parts by mass) was added over ten minutes under stirring at 30° C. The system was left to stand for three minutes, and then was heated over 60 minutes to 80° C. While the system was kept at 80° C., a particle growth reaction was continued. In this state, the diameters of associated particles were measured with "Multisizer 3" (made by Beckman Coulter, Inc.). When the volume-based median diameter (D50) reached 6.3 μm, Hybrid amorphous polyester resin nanoparticle dispersion [1] (50 parts by mass) was added, and was left to stand for 15 minutes under stirring. An aqueous solution of sodium chloride (190 parts by mass) in deionized water (760 parts by mass) was added to terminate the growth of particles. The system was further heated at 90° C. under stirring to fuse the particles. When the average circularity of the toner measured with an analyzer "FPIA-2100"(made by Sysmex Corporation) (the number of particles to be detected at HPF: 4000 particles) reached 0.955, the system was cooled to 30° C. to prepare a dispersion of a particulate toner matrix.

The dispersion of the particulate toner matrix was subjected to solid liquid separation with a centrifuge to extract a wet cake of the particulate toner matrix. The wet cake was centrifugally washed with deionized water at 35° C. until the filtrate had an electric conductivity of 5 μS/cm, and then was placed into a "flash jet dryer" (made by Seishin Enterprise Co., Ltd.) to dry the wet cake until the moisture content reached 0.5 mass %. Particulate toner matrix 7 was thereby prepared.

(6) Preparation of Hybrid Amorphous Polyester Resin Nanoparticle Dispersion (6-1) Synthesis of Hybrid Amorphous Polyester Resin Into a 10-L four-necked flask equipped with a nitrogen inlet pipe, a dehydration tube, a stirrer, and a thermocouple, bisphenol A propylene oxide 2 mol adduct (480 parts by mass), terephthalic acid (130 parts by mass), fumaric acid (85 parts by mass), and an esterification catalyst (tin octylate) (2 parts by mass) were placed, and were subjected to a condensation polymerization reaction at 230° C. for eight hours. These materials were further reacted at 8 kPa for one hour, and were cooled to 160° C. A mixture of acrylic acid (8.6 parts by mass), styrene (131 parts by mass), butyl acrylate (30 parts by mass), and a polymerization initiator (di-t-butyl peroxide) (10 parts by mass) was then added dropwise with a dropping funnel over one hour. The addition polymerization reaction was continued for one hour while the system was kept at 160° C. The system was then heated to 200° C., and was kept at 10 kPa for one hour. Acrylic acid, styrene, and butyl acrylate were then removed to prepare a hybrid amorphous polyester resin.

<Preparation of Particulate Toner Matrix 8>

Particulate toner matrix 8 was prepared as in "(4) Preparation of particulate toner matrix" in Preparation of Particulate toner matrix 1 except that Crystalline polyester resin nanoparticle dispersion [2] was not added.

<Average Circularity of Particulate Toner Matrix>

The average circularity of the particulate toner matrix can be measured with "FPIA-2100" (made by Sysmex Corporation). Specifically, a sample (toner) is mixed with an aqueous solution containing a surfactant, and is ultrasonically dispersed for one minute. The sample is photographed with "FPIA-2100" in a high power field (HPF) mode at an appropriate density (the number of particles to be detected at HPF: 3000 to 10000 particles). The circularities of the photographed particulate toner matrices are calculated from the following expression. The circularities of the particulate toner matrices are added, and the total is divided by the total number of particulate toner matrices to give the average circularity of the particulate toner matrix. The number of particles to be detected at an HPF within this range can provide reproductivity in the measurement.

circularity=(perimeter of circle having projected area identical to that of particle image)/(perimeter of projected image of particle)

TABLE 1

| Particulate toner matrix No. | Type of crystalline polyester resin | Shell | | Circularity |
|---|---|---|---|---|
| | | Presence/absence | Type of resin | |
| 1 | Crystalline polyester resin | Absence | — | 0.955 |
| 2 | Crystalline polyester resin | Absence | — | 0.945 |
| 3 | Crystalline polyester resin | Absence | — | 0.965 |
| 4 | Crystalline polyester resin | Absence | — | 0.940 |
| 5 | Crystalline polyester resin | Absence | — | 0.970 |
| 6 | Hybrid crystalline polyester resin | Absence | — | 0.955 |
| 7 | Hybrid crystalline polyester resin | Presence | Hybrid amorphous polyester resin | 0.955 |
| 8 | — | Absence | — | 0.955 |

<Preparation of Silica Particles [1]>

Silicon tetrachloride (SiCl4) at 108 kg/h, hydrogen (primary combustible gas) at 14 $m^3$/h (at normal state), and air (primary oxygen-containing gas) at 140 $m^3$/h (at normal state) were introduced into a mixing chamber of a burner. The mixed gas was injected from the burner, and was burned in a reaction chamber. Hydrogen (secondary combustible gas) at 21 $m^3$/h (at normal state) and air (secondary oxygen-containing gas) at 40 $m^3$/h (at normal state) were further fed to the chamber to yield Unmodified silica particles [1]. Unmodified silica particles [1] (hydrophilic silica powder) (100 parts by mass) were placed into a reactor, and 5 parts by mass of water and hexamethyldisilazane (abbreviated to "HMDS") in an amount shown in Table 2 were sprayed under a nitrogen atmosphere. The reaction mixture was stirred at 150° C. for two hours, and was further stirred at 220° C. for two hours under a nitrogen stream into dryness. The product was cooled to yield Silica particles [1].

<Preparation of Silica Particles [2] to [11]>

Silica particles [2] to [11] were prepared as in the preparation of Silica particles [1] except that the ratio γ (primary), the ratio γ (total), and the type of the surface modifier were varied. In Silica particles [2] to [11], the ratio γ (primary), the ratio γ (total), the primary particle diameter, the circularity, and the absence/presence of the secondary particles having an aspect ratio of 3.0 or more are as shown in Table 2.

<Measurement of Diameters of Primary Silica and Titanium Oxide Particles>

The diameters of the primary silica and titanium oxide particles were measured as follows: Silica particles or titanium oxide particles were externally added to (dispersed on) the particulate toner matrix, and 100 primary silica or titanium oxide particles were observed at 40000× with a scanning electron microscope "JSM-7401F" (made by JEOL, Ltd.). The major axis diameters and the minor axis diameters of the particles were measured by image analysis of the primary particles. From these intermediate values, the sphere equivalent diameters were determined as "diameters of the primary silica particles" or "diameters of the primary titanium oxide particles".

(Measurement of Average Aspect Ratio of Secondary Particles)

The average aspect ratio, i.e., the ratio "average major axis diameter/average minor axis diameter" of the secondary particles (silica particles) was determined from the average major axis diameter and the average minor axis diameter. The average major axis diameter and the average minor axis diameter were determined as follows: Twenty secondary particles were extracted at random from an electron microscopic photograph taken with a scanning electron microscope (SEM) "JSM-7401F" (made by JEOL, Ltd.) to measure the major axis diameters and the minor axis diameters thereof. The major axis diameters and the minor axis diameters of these twenty secondary particles were averaged, and the number average major axis diameter and the number average minor axis diameter were defined as the average major axis diameter and the average minor axis diameter. Among the twenty secondary particles extracted, those having an aspect ratio of 3.0 or more were counted, and are shown in Table 2.

The "major axis diameter" of the secondary particle refers to the length between two parallel lines at the longest interval contacting the contour of the secondary particle in a photographic image of secondary particles taken at a magnification of 40000x with a scanning electron microscope (SEM; "JSM-7401F" (made by JEOL, Ltd.). The "minor axis diameter" refers to the length between two parallel lines contacting the contour of the secondary particle and extending orthogonal to the parallel lines defining the major axis diameter.

TABLE 2

| Silica particles No. | γ (Primary) | γ (Total) | Type of surface modifier | Primary particle diameter [nm] | The number of secondary particles having aspect ratio of 3.0 or more | Circularity |
|---|---|---|---|---|---|---|
| 1 | 0.5 | 1.5 | HMDS | 60 | 5 | 0.35 |
| 2 | 0.5 | 1.5 | Silicone oil | 60 | 6 | 0.35 |
| 3 | 0.5 | 2.0 | Silicone oil | 30 | 9 | 0.33 |
| 4 | 0.5 | 2.7 | Silicone oil | 25 | 11 | 0.32 |
| 5 | 0.5 | 1.2 | Silicone oil | 90 | 3 | 0.40 |
| 6 | 0.5 | 1.1 | Silicone oil | 95 | 2 | 0.42 |
| 7 | 0.3 | 1.5 | Silicone oil | 40 | 8 | 0.25 |
| 8 | 0.25 | 1.5 | Silicone oil | 27 | 10 | 0.23 |
| 9 | 0.7 | 1.5 | Silicone oil | 60 | 6 | 0.49 |
| 10 | 0.75 | 1.5 | Silicone oil | 60 | 6 | 0.51 |
| 11 | 0.75 | 1.2 | Silicone oil | 90 | 0 | 0.55 |

<Measurement of Average Circularity of Secondary Particles>

The average circularities of the secondary particles were measured as follows.

One hundred of secondary particles were photographed at 40000× with a scanning electron microscope "JSM-7401F" (made by JEOL, Ltd.). The photographed image was read in with a scanner. The secondary particles were binarized with an image processing analyzer "LUZEX (registered trademark) AP" (made by NIRECO CORPORATION), and the circle equivalent perimeters and perimeters of 100 particles were determined. The circularities of the external additive particles were averaged from the following expression (1), and the resulting value was defined as the average circularity of the secondary particles (as in the calculation of the average particle diameter).

$$\text{circularity}=(\text{circle equivalent perimeters of particle})/(\text{perimeter of particle})=[2\times(A\pi)^{1/2}]/PM \quad \text{Expression (1):}$$

In Expression (1), A represents the projected area of a secondary particle, and PM represents the perimeter of the secondary particle.

<Preparation of Titanium Oxide Particles [1]>

In this Example, titanium oxide particles were prepared as follows with reference to the process of preparing needle-like titanium oxide nanoparticles described in Japanese Patent Application Laid-Open No. 2004-315356.

(1) Methanol (700 parts by mass) was stirred with a 3-L reactor equipped with a stirrer, a dropping funnel, and a thermometer. Titanium isopropoxide (450 parts by mass) was added dropwise, and stirring was continued for three minutes. The resulting titanium oxide particles were then centrifugally separated, were recovered, and were dried under reduced pressure to yield amorphous titanium oxide.

(2) The amorphous titanium oxide was heated in the air at 800° C. for five hours in a high temperature electric furnace to yield rutile titanium oxide particles.

(3) The resulting rutile titanium oxide particles (500 g) and octyltrimethoxysilane (15 parts by mass) were placed into the 3-L reactor equipped with a stirrer, a dropping funnel, and a thermometer, and were stirred in toluene (2 L) for 10 hours to be hydrophobized. The reaction product was then centrifuged to wash off the reaction solvent, and was re-centrifuged to be recovered. The product was dried under reduced pressure to yield Titanium oxide particles [1].

<Preparation of Titanium Oxide Particles [2] to [5]>

Titanium oxide particles [2] to [5] were prepared as in the preparation of Titanium oxide particles [1] except that the heating condition of the high temperature electric furnace was varied as shown in Table 3.

<Measurement of Average Aspect Ratio of Titanium Oxide Particles>

The average aspect ratio of the titanium oxide particles was determined as in the measurement of the average aspect ratio of the secondary particles except that the secondary particles (silica particles) were replaced with the titanium oxide particles.

TABLE 3

| Titanium oxide particles No. | Conditions of high temperature electric furnace Temperature [° C.] | Time [h] | Average major axis diameter [nm] | Average minor axis diameter [nm] | Average aspect ratio |
|---|---|---|---|---|---|
| 1 | 800 | 5 | 52 | 13 | 4.0 |
| 2 | 750 | 5 | 30 | 10 | 3.0 |
| 3 | 700 | 4 | 27 | 9 | 3.0 |
| 4 | 700 | 5 | 27 | 10 | 2.7 |
| 5 | 850 | 5 | 70 | 20 | 3.5 |
| 6 | 900 | 5 | 74 | 21 | 3.5 |

<Preparation of Toner 1 (External Additive Treatment Step)>

Primary silica nanoparticles (HMDS treated, diameter: 12 nm, small-diameter external additive) (0.60 mass %), Silica particles [1] (1.50 mass %), and Titanium oxide particles [1] (0.50 parts by mass) were added to "Particulate toner matrix 1" (100 parts by mass) in a Henschel mixer "FM20 C/I" (made by NIPPON COKE & ENGINEERING CO., LTD.), and were stirred for 15 minutes with a blade at a rotational frequency, i.e., a circumferential speed of 40 m/s at the distal end. "Toner 1" was thereby prepared. The temperature of the product during external addition was set to be 40±1° C. The internal temperature of the Henschel mixer was controlled with cooling water at a flow rate of 5 L/min through an external bath of the Henschel mixer if the temperature reached 41° C. and with cooling water at 1 L/min if the temperature reached 39° C.

<Preparation of Toners 2 to 23>

Toners 2 to 23 were prepared as in Toner 1 except that the types of the particulate toner matrix and the external additive, and the amount thereof to be added were varied as shown in Table 4. Similarly, the rotational frequency or circumferential speed was set at 40 m/s, and the temperature of the product during external addition was set to be 40±1° C. The internal temperature of the Henschel mixer was controlled with cooling water at a flow rate of 5 L/min through the external bath of the Henschel mixer if the temperature reached 41° C. and with cooling water at 1 L/min if the temperature reached 39° C.

TABLE 4

| Toner No. | Particulate toner matrix No. | Silica particles No. | Titanium oxide particles No. |
|---|---|---|---|
| 1 | 1 | 1 | 1 |
| 2 | 1 | 2 | 1 |
| 3 | 2 | 2 | 1 |
| 4 | 3 | 2 | 1 |
| 5 | 4 | 2 | 1 |
| 6 | 5 | 2 | 1 |
| 7 | 6 | 2 | 1 |
| 8 | 7 | 2 | 1 |
| 9 | 8 | 2 | 1 |
| 10 | 7 | 3 | 1 |
| 11 | 7 | 4 | 1 |
| 12 | 7 | 5 | 1 |
| 13 | 7 | 6 | 1 |
| 14 | 7 | 7 | 1 |
| 15 | 7 | 8 | 1 |
| 16 | 7 | 9 | 1 |
| 17 | 7 | 10 | 1 |
| 18 | 7 | 11 | 1 |
| 19 | 7 | 2 | 2 |
| 20 | 7 | 2 | 3 |
| 21 | 7 | 2 | 4 |
| 22 | 7 | 2 | 5 |
| 23 | 7 | 2 | 6 |

<Preparation of Developer>

Toners 1 to 23 prepared above were each mixed with a ferrite carrier such that the content of the toner was 6 mass %, the ferrite carrier being coated with a copolymerization resin of cyclohexyl methacrylate and methyl methacrylate (monomer mass ratio=1:1) and having a volume average particle diameter of 30 μm. Developers 1 to 23 were thereby prepared, and were evaluated as follows. The mixing was performed with a V-type mixer for 30 minutes.

[Evaluation]

<Evaluation of Low-Temperature Off-Setting>

In a modified machine of "bizhub PRO C6500" (made by KONICA MINOLTA, INC.), an A4 image of black solid stripes having a width of 5 mm in a direction perpendicular to the feeding direction was fed and fixed onto a size A4 sheet of high quality paper having a base weight of 80 g under an environment at normal temperature and normal humidity (temperature: 20° C., humidity: 50% RH). In the subsequent fixing test, an A4 image consisting of an image of black solid stripes having a width of 5 mm perpendicular to the feeding direction and a halftone image having a width of 20 mm was fed and fixed in a long edge feed mode. This operation was repeated while the fixing temperature was varied from 80° C., 85° C., . . . to 180° C. at an increment of 5° C. The temperature was measured when image dirt attributed to fixing off-setting occurred, and the lowest temperature at which no image dirt caused by fixing off-setting was visually recognized was defined as the lowest fixing temperature.

<Measurement of Silica Content on Image (Normal State)>

In the present invention, the silica density on an image is measured with an "X-ray photoelectron spectroscope (ESCA-1000)" (made by SHIMADZU Corporation).

In a modified machine of "bizhub PRO C6500" (made by KONICA MINOLTA, INC.), one-sided print operations were continuously performed on 50 sheets of POD128 gsm paper at a sheet feeding rate of 250 mm/sec (linear velocity). In the one-sided print, a solid image having a toner density of 5 mg/cm$^2$ was fixed onto one surface of the transfer sheet at a fixing temperature of 140° C. The image was analyzed at an X-ray intensity of 10, 30 mA, and an analysis depth in a normal mode; from the element peak intensities of Si, Ti, C, and O, the silica content (atm %) on the image was calculated. Evaluation was performed according to the following criteria:

A: Very good; a silica content of 3.0 (atm %) or more tends to significantly enhance the document off-setting resistance.

B: Good; a silica content of 2.0 (atm %) or more and less than 3.0 (atm %) tends to enhance the document off-setting resistance.

C: Practical level; a silica content of 1.0 (atm %) or more and less than 2.0 (atm%) tends to give document off-setting resistance at a practical level.

D: Bad; a silica content of less than 1.0 (atm %) tends to give poor document off-setting resistance.

<Image Storage Property (Document Off-Setting Resistance) (Normal State)>

In a modified machine of "bizhub PRO C6500"(made by KONICA MINOLTA, INC.), a chart having a coverage rate of 10% was printed on 10000 sheets at a sheet feeding rate of 250 mm/sec (linear velocity). Double-sided print operations were then continuously performed on 50 sheets. In the double-sided print, a solid image having a toner amount of 5 mg/cm$^2$ was fixed onto one surface of the transfer sheet, and a text image having alphabetical letters of 6.0 point in 36 lines was fixed onto the upper half of the other face of the transfer sheet and a solid image having a toner amount of 5 mg/cm$^2$ was fixed onto the lower half of the other face of the sheet.

A pile of these 50 printed sheets were placed on a marble table, and a weight was placed thereonto so as to apply a pressure of 19.6 kPa (200 g/cm$^2$) to the sheets. The sheets were left to stand in this state for three days under an environment at a temperature of 30° C. and a humidity of 60%RH. The sheets carrying the fixed images in the pile were peeled off to evaluate the degree of image deficits in the fixed images. The results are shown in Table 5. In the present invention, fixed images ranked as "A: Very good", "B: Good", and "C: Practical level" are acceptable.

(Criteria for Evaluation)

A: Very good; no image failure caused by the transfer of the toner, no adhesion between fixed images, and no image deficits are found.

B: Good; no image failure and no image deficits are found although two printed sheets in the pile are peeled from each other with a crisp sound.

C: Practical level; no image failure and few image deficits are found although peeling of two printed sheets in the pile results in uneven gross of the fixed image.

D: Bad; the transfer of the image is found in the background region of the text image, or deficits in the text image or projections in the background region are generated in the text image and the background region contacting the text image due to the migration of the text image.

<Measurement of Silica Content on Image, Image Storage Property (Low Coverage Rate)>

The silica content on the image was measured and the image storage property was evaluated as in the measurement of the silica content on the image and the image storage property (document off-setting resistance) in the normal state except that a charge having a coverage rate of 3%, rather than the chart having a coverage rate of 10%, was printed on 10000 sheets.

TABLE 5

| | | Silica content on image | | | | | | |
|---|---|---|---|---|---|---|---|---|
| | | Normal state | | Low coverage state | | | | |
| Toner/ Developer No. | Low-temperature off-setting [° C.] | Silica content [atm %] | Evaluation | Silica content [atm %] | Evaluation | Image storage property Normal state | Image storage property Low coverage state | Note |
| 1 | 140 | 3.52 | A | 3.04 | A | A | B | Inventive |
| 2 | 140 | 3.54 | A | 3.12 | A | A | A | Inventive |
| 3 | 140 | 3.12 | A | 2.17 | B | A | B | Inventive |
| 4 | 140 | 4.00 | A | 2.07 | B | A | B | Inventive |
| 5 | 140 | 2.90 | B | 1.87 | C | A | C | Inventive |
| 6 | 140 | 4.14 | A | 1.92 | C | A | C | Inventive |
| 7 | 135 | 3.43 | A | 2.04 | B | A | A | Inventive |
| 8 | 130 | 3.43 | A | 3.01 | A | A | A | Inventive |
| 10 | 140 | 2.56 | B | 1.83 | C | B | C | Inventive |
| 12 | 140 | 3.42 | A | 1.74 | C | A | C | Inventive |
| 14 | 140 | 2.66 | B | 1.77 | C | B | C | Inventive |
| 16 | 140 | 3.08 | A | 1.81 | C | A | C | Inventive |
| 19 | 140 | 3.08 | A | 2.01 | B | A | B | Inventive |
| 20 | 140 | 2.98 | B | 1.88 | C | B | C | Inventive |
| 21 | 140 | 2.77 | B | 1.90 | C | B | C | Inventive |
| 22 | 140 | 3.12 | A | 2.15 | B | A | B | Inventive |
| 23 | 140 | 3.04 | A | 1.71 | C | A | C | Inventive |
| 9 | 165 | 3.62 | A | 2.23 | B | A | A | Comparative |
| 11 | 140 | 2.05 | B | 0.94 | D | B | D | Comparative |
| 13 | 140 | 3.51 | A | 0.81 | D | A | D | Comparative |
| 15 | 140 | 2.01 | B | 0.91 | D | B | D | Comparative |
| 17 | 140 | 3.55 | A | 0.80 | D | A | D | Comparative |
| 18 | 140 | 3.41 | A | 0.95 | D | A | D | Comparative |

(SUMMARY )

The results in Table 5 show that the present invention provides toners having higher low-temperature fixing characteristics and higher image storage property than those of the toners in Comparative Examples.

In observation of Silica particles 1 to 11 with a scanning electron microscope, primary particles contacting each other are considered as primary particles fused to form secondary particles.

Although embodiments of the present invention have been described and illustrated in detail, it is clearly understood that the same is by way of illustration and example only and not limitation, the scope of the present invention should be interpreted by terms of the appended claims.

What is claimed is:

1. An electrostatic charge image developing toner comprising toner particles comprising a particulate toner matrix, and an external additive adhering to a surface of the particulate toner matrix, wherein the particulate toner matrix comprises a crystalline polyester resin, the external additive comprises silica particles, the silica particles are secondary particles comprising primary particles having a diameter in the range of 30 to 90 nm, the secondary particles have an average circularity in the range of 0.25 to 0.50, and the secondary particles have an average aspect ratio of 3.0 or more.

2. The electrostatic charge image developing toner according to claim 1, wherein the particulate toner matrix has an average circularity in the range of 0.945 to 0.965.

3. The electrostatic charge image developing toner according to claim 1, wherein the external additive further comprises titanium oxide particles having an average aspect ratio of 3.0 or more.

4. The electrostatic charge image developing toner according to claim 3, wherein the titanium oxide particles have an average major axis diameter in the range of 30 to 70 nm.

5. The electrostatic charge image developing toner according to claim 1, wherein the silica particles have surfaces modified with silicone oil.

6. The electrostatic charge image developing toner according to claim 1, wherein the silica particles have surfaces modified with a trimethylsilyl group.

7. The electrostatic charge image developing toner according to claim 1, wherein a content of the silica particles is within the range of 2.0 to 5.0 mass % relative to 100 mass % of the particulate toner matrix.

8. The electrostatic charge image developing toner according to claim 3, wherein a content of the titanium oxide particles is within the range of 0.10 to 0.80 mass % relative to 100 mass % of the particulate toner matrix.

9. The electrostatic charge image developing toner according to claim 3, wherein the titanium oxide particles have a rutile crystal structure.

10. The electrostatic charge image developing toner according to claim 3, wherein the titanium oxide particles have surfaces modified with a coupling agent having a linear alkyl group having 6 to 10 carbon atoms.

11. The electrostatic charge image developing toner according to claim 3, wherein the titanium oxide particles have surfaces modified with an octylsilyl group.

12. The electrostatic charge image developing toner according to claim 1, wherein the crystalline polyester resin comprises a hybrid crystalline polyester resin prepared through chemical bond of at least a crystalline polyester polymer segment and a second polymer segment.

13. The electrostatic charge image developing toner according to claim 1, wherein the particulate toner matrix has a core-shell structure comprising a core particle and a shell coating the surface of the core particle, and the shell comprises an amorphous polyester resin.

14. The electrostatic charge image developing toner according to claim 13, wherein the amorphous polyester resin comprises a hybrid amorphous polyester resin prepared through chemical bond of at least an amorphous polyester polymer segment and a second polymer segment.

* * * * *